US007515145B2

(12) United States Patent
Speirs

(10) Patent No.: US 7,515,145 B2
(45) Date of Patent: Apr. 7, 2009

(54) ARRANGEMENT FOR DRIVING A DISPLAY DEVICE

(75) Inventor: Christopher Rodd Speirs, Zurich (CH)

(73) Assignee: NXP B.V., Eindhoven (NL)

( * ) Notice: Subject to any disclaimer, the term of this patent is extended or adjusted under 35 U.S.C. 154(b) by 1023 days.

(21) Appl. No.: 10/310,729

(22) Filed: Dec. 5, 2002

(65) Prior Publication Data

US 2003/0112212 A1 Jun. 19, 2003

(30) Foreign Application Priority Data

Dec. 7, 2001 (DE) ..... 101 60 098

(51) Int. Cl.
*G09G 5/00* (2006.01)

(52) U.S. Cl. ..... 345/204; 345/87; 345/98; 345/100; 345/206; 345/210

(58) Field of Classification Search ..... 345/87, 345/98, 100, 204, 210, 206; 341/144
See application file for complete search history.

(56) References Cited

U.S. PATENT DOCUMENTS 5,952,948 A * 9/1999 Proebsting ..... 341/144
5,954,820 A * 9/1999 Hetzler ..... 713/323
6,118,439 A * 9/2000 Ho et al. ..... 345/211
6,201,522 B1 * 3/2001 Erhart et al. ..... 345/96
6,243,817 B1 * 6/2001 Melo et al. ..... 713/300
6,411,273 B1 * 6/2002 Nakamura et al. ..... 345/98
6,850,218 B2 * 2/2005 Waterman ..... 345/103

* cited by examiner

*Primary Examiner*—Richard Hjerpe
*Assistant Examiner*—Leonid Shapiro

(57) ABSTRACT

The invention relates to an arrangement for driving a display device with columns and rows in which different voltage values may be fed to columns of the display device in dependence upon the data to be displayed. The invention also relates to a display device with a driving arrangement. In order to provide an arrangement for driving a display device in which the energy consumption is reduced, an arrangement (1, 40) for driving a display device (2) with columns and rows is proposed in which voltages can be fed to the columns of the display device voltages in dependence on the data to be supplied, with two supply voltage lines carrying a maximum and a minimum column voltage (Vcolmax and Vcolmin), wherein at least one voltage divider unit (43) is arranged between the supply voltage lines for the generation of divided voltage values, and a supply of the divided voltage values to column output circuits ($\mathbf{41}_N$) is provided, with a column output circuit ($\mathbf{41}_N$) comprising at least one switching matrix (411) and/or amplifier unit (412), it being possible to disconnect the switching matrix and/or amplifier units from the supply voltage lines by means of switches (S1, S2) and to connect one of the supply voltages to a column output by means of switches (S3-S5).

20 Claims, 2 Drawing Sheets

ARRANGEMENT FOR DRIVING A DISPLAY DEVICE

Figure 1:
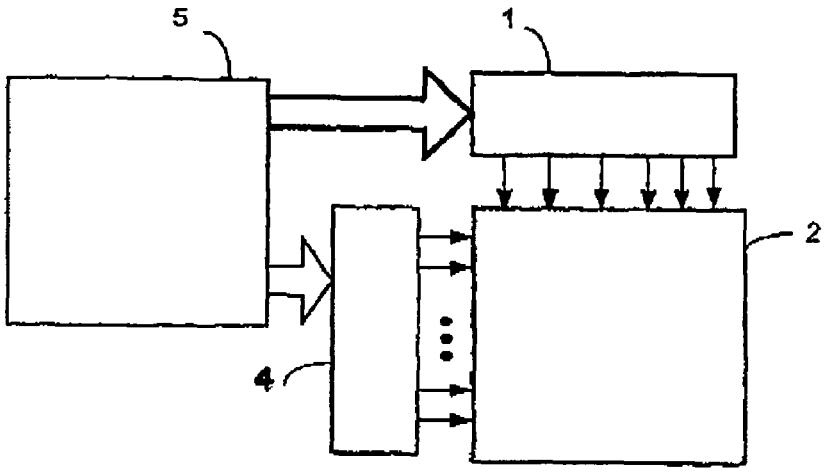
FIG.1 PRIOR ART

The invention relates to an arrangement for driving a display device with columns and rows, in which different voltage values are fed to the display device's columns depending upon the data to be displayed. The invention also relates to a display device with a driving arrangement.

Display technology will occupy an increasingly important role in information and communications technology in future years. As an interface between humans and the digital world, the display device is of central importance for the acceptance of modern information systems. In particular transportable devices such as, for example, notebooks, telephones, digital cameras, and personal digital assistants are not feasible without the use of displays. There are in principle two types of displays. These are, on the one hand, passive matrix displays and, on the other, active matrix displays. Passive displays are a popular type of display technology used, for example, in laptops and mobile telephones. Passive matrix display technology may be used to achieve large displays, with these generally being based on the (S)TN (super twisted nematic) effect.

Great significance is now attached to active matrix displays, since this technology enables rapid image changes, for example the representation of a mouse pointer or film. With this active matrix LCD technology, the picture elements or pixels are actively driven. The most frequently used variant here works with thin-film transistors (TFT-LCD). For this, silicon transistors, integrated directly in every pixel, enable the storage of the image signals in the pixel. In order to achieve different gray levels or colors when displaying information, it is necessary to drive the displays or display devices with correspondingly different voltages from a large voltage range. Driver circuits are used for this driving of the display device or displays.

Active matrix displays (TFT displays) typically comprise a glass with outward facing connectors to which the driver circuits or driving arrangements are connected. These driver circuits convert the image signals or data to be shown on a display into the corresponding voltage values. The image information is stored in memories as digital signals or data. The digital signals have to be converted into analog signals, so that an analog voltage can serve to display a corresponding luminous intensity. The digital analog converters required for this conversion have to convert digital signals into voltages covering a range of less than 20 mV to more than 10 V.

In portable devices, energy consumption is a particularly important criterion since this determines the lifetime of the battery in the device and hence the duration of use of the device.

In the driver circuits known at present for active matrix displays, a digital/analog converter and an amplifier are required for every column. These cannot be disconnected, i.e. they require a quiescent current when they are not converting and amplifying voltage.

Therefore, it is the object of the invention to provide an arrangement for driving a display device in which the energy consumption is reduced.

This object is achieved with an arrangement for driving a display device with columns and rows in which different voltages may be fed to the display device's columns in dependence on the data to be displayed, with two supply voltage lines carrying a maximum and a minimum column voltage, wherein at least one voltage divider unit is arranged between the supply voltage lines for the generation of divided voltage values, and a supply of the divided voltage values to column output circuits is provided, with a column output circuit comprising at least one switching matrix and/or amplifier unit, and wherein switches enable the switching matrix and/or amplifier units to be disconnected from the supply voltage lines, and other switches enable one of the supply voltages to be switched to a column output.

The invention is based on the idea that the full scope of power or scope of display of a portable electronic device is generally only required for a short time. For the rest of the time, simplified displays are usually sufficient. In order to utilize correctly a frequently used partial mode or standby mode also with regard to energy conservation, switching off the assemblies not required in the standby mode may achieve a significant energy saving.

For this, it is proposed according to the invention that the unrequired column output circuits in the standby mode be separated from the supply voltage. In addition, the voltage divider unit for generation of the partial voltage values will be separated from the supply voltage in the standby mode. The switches in the column output circuit are switched in such a way that, depending upon the data to be displayed, one of the two supply voltages Vcolmax or Vcolmin is fed to the column output.

The switchable column output circuits according to the invention enable the amplifier units to be disconnected and the supply voltages to be applied directly to the driver circuit's column outputs. In implementations according to prior art, in non-disconnectable circuitry, it is much more difficult for the column output circuits to control the amplifiers in such a way that the supply voltages are applied to the amplifier output/column output.

Every pixel in a color active matrix display is, for example, assigned three TFT transistors to switch the corresponding colors red, green and blue. These TFT transistors are driven in dependence on the data to be displayed with one of the two supply voltages in order to be either switched on or off. This enables the generation of 8 different hues with only two different voltages, namely the two supply voltages Vcolmax or Vcolmin.

The object is also achieved by a display device with an arrangement for driving the display device with two supply voltage lines carrying a maximum and a minimum column voltage, wherein at least one voltage divider unit is arranged between the supply voltage lines for the generation of divided voltage values, and a supply of the partial voltage values to column output circuits is provided, with one column output circuit comprising at least one switching matrix and/or amplifier unit, it being possible to disconnect the switching matrix and/or amplifier units from the supply voltage lines by means of switches and to connect one of the supply voltages to a column output by means of switches.

Figure 2:
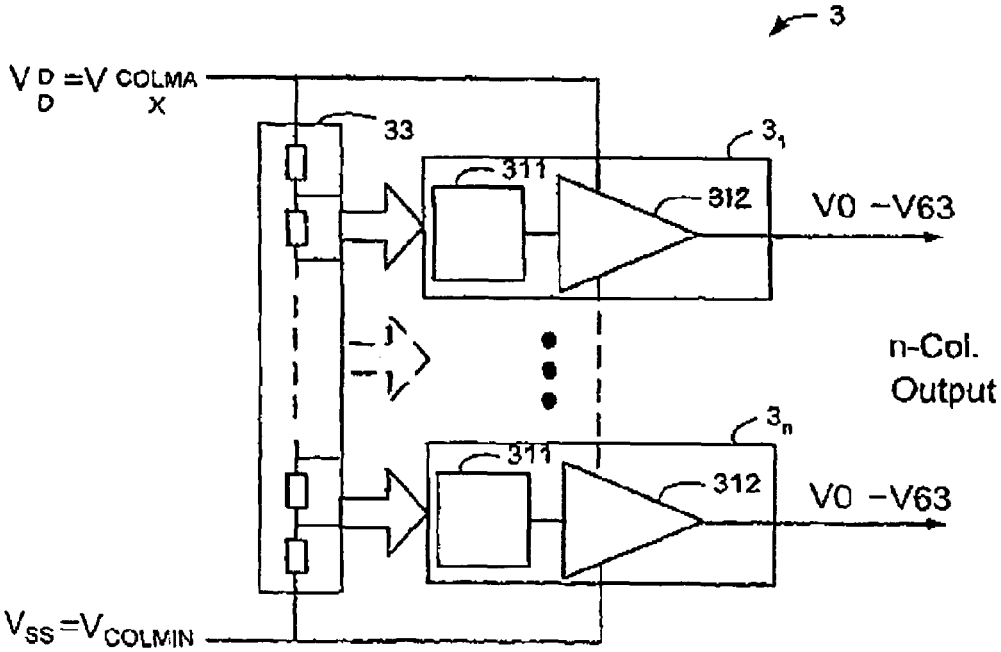
FIG.2 PRIOR ART

The invention will be further described with reference to embodiments shown in the drawings to which, however, the invention is not restricted, and in which:

FIG. 1 a block diagram for driving a display device,

FIG. 2 shows a driver circuit known from the prior art, and

Figure 3:
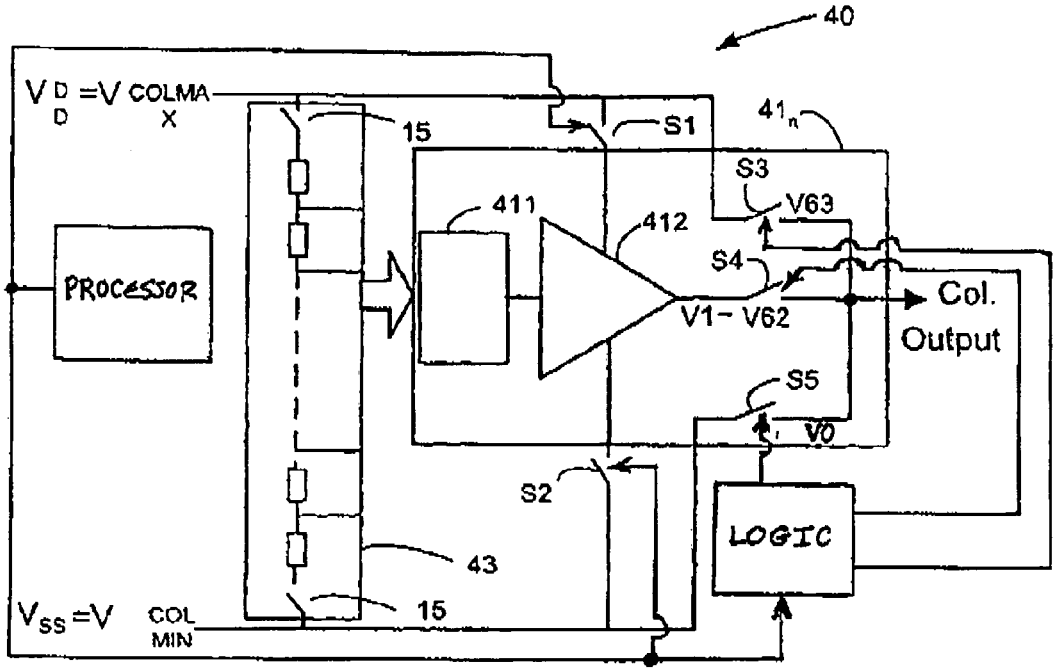

FIG. 3 shows a driver circuit according to the invention with column output circuits FIG. 1 is a block diagram for driving a display 2. The information to be displayed is stored in the unit 4 or is generated by this. The display 2 is assigned at least one column driver 1 and one row driver 4. Every pixel in the display is assigned at least one TFT transistor (not shown). The transistors in a row are activated in series. The application of a corresponding column voltage to the TFT transistor causes the correspondingly activated pixel to adopt the gray level corresponding to the column voltage.

FIG. 2 shows an arrangement 3 for driving a display device known from the prior art. This arrangement 3 has a voltage divider unit 33 which, depending upon the data or image information to be displayed, generates divided voltages which are fed to the respective column output circuits 3*n*. These column output circuits each contain a switching matrix 311 and an amplifier 312. The switching matrix 311 together with the voltage divider unit 33 forms a digital-analog converter. The amplifiers 312 are each connected to the supply voltage Vdd and Vss. Every column input of the display is assigned a column output circuit. This enables all possible column voltage values to be fed to each column of the displays. In this example, the voltage divider unit 33 may be used to generate a total of 64 different divided voltages, which are amplified into 64 different column voltage values V0-V63.

If, with this arrangement in accordance with known prior art, the display device is switched to a standby mode, all the amplifiers 312 and also the voltage divider unit 33 remain connected to the supply voltage VDD and VSS. Since it is not necessary for the standby mode to generate as many column voltages as in the normal display mode, the amplifiers 312 are driven in such a way that they supply a voltage approximating the supply voltages VDD or VSS at the output. The power consumption for the operation of the column output circuits and in particular of the amplifiers however, is not necessary since the supply voltages VDD and VSS are available in the arrangement 3.

Therefore, FIG. 3 shows an arrangement according to the invention for driving a display device. This arrangement 40 comprises a voltage divider unit 43, and in addition each column output n is assigned a column output circuit $\mathbf{41}_N$. The voltage divider unit 43 may be disconnected from the supply voltage $V_{DD}$ and $V_{SS}$ by means of a switching unit 15 in the standby mode. In addition, the individual amplifiers 412 and the switching matrices 411 in the column output circuits $\mathbf{41}_N$ may be separated or disconnected from the supply voltage. Together with the voltage divider unit 43, the switching matrices 411 each form a DA converter. The column output circuits $\mathbf{41}_N$ are provided with switches S1 to S5. During operation of the display device 2 in the standby mode, not as many partial voltage values are required as in normal mode, since the number of gray levels or color levels is reduced. It is often sufficient to drive the TFT transistors of the display device with the two supply voltages $V_{DD}$ and $V_{SS}$. For this, the switches S1 to S5 in the column output circuit $\mathbf{41}_N$ are driven in such a way that the amplifiers 412 and also the switching matrices 411 are disconnected and hence do not use any further power. Depending upon the image information, either the $V_{dd}$ or the $V_{ss}$ voltage is then fed to the column outputs n as a column voltage.

The switches S1 and S2 are opened, for example, by activating the standby modes by means of a processor (not shown). This separates the relevant column output circuit from the supply voltage and so that it does not consume any further power. Alternatively, the amplifier units 412 may be internally disconnected for this. The switches S1 and S2 do not have to be arranged in every column output circuit. It is sufficient to interrupt the supply voltage feed for all the column output circuits.

The control of the switches S3 to S5 is implemented by means of simple logic circuits. The maximum supply voltage is fed to switch S3 if the column associated with the column output circuit is to be set for the standby mode, or the data "111111" are applied. Correspondingly, this means that the switch S5 must be closed if the lowest voltage is required for the corresponding column, i.e. the column is to remain disconnected in the standby mode, or the data "000000" is fed to the driver circuit. The switch S4 is only closed in the normal mode, in the standby mode it is permanently open for all column output circuits. This may be derived by a negation function of the two switches S5 and S3.

Internally, the amplifiers comprise switches in the output stages, which may be used alternatively or also in conjunction with the external switches, in order to switch the $V_{DD}$ or the $V_{SS}$ to the corresponding column output. The internal switches are each connected to the $V_{DD}$ or the $V_{SS}$.

The following shows a table explaining the color mixture for a pixel. A pixel comprises three sub-pixels with the colors red, green and blue. The application of different column voltages to these three TFT transistors enables the recognizable color of the pixel on the display device to be varied. The table rows show the colors which may be displayed on the display device.

| | Red | Green | Blue |
|---|---|---|---|
| Black | 0 | 0 | 0 |
| Blue | 0 | 0 | 1 |
| Green | 0 | 1 | 0 |
| Cyan | 0 | 1 | 1 |
| . | 1 | 0 | 1 |
| . | . | . | . |
| . | . | . | . |
| White | 1 | 1 | 1 |

The invention claimed is:

1. An arrangement comprising:

a display device with columns and rows, a column driver that is configured to provide voltages to the columns of the display device in dependence upon the data to be displayed, two supply voltage lines carrying a maximum and a minimum column voltage, and a processor that is configured to control the column driver, wherein the column driver includes:

at least one voltage divider unit that is arranged between the supply voltage lines for the generation of divided voltage values, and at least one switching matrix that is configured to couple the divided voltage values to the columns, the processor is configured to control the column driver in a select one of two modes, such that, in an operational mode, the column driver selectively couples the divided voltage values to the columns via the switching matrix, and in a standby mode, the column driver is configured to:

disconnect the switching matrix from the supply voltage lines, and selectively connect one of the supply voltages to each of the columns.

2. An arrangement as claimed in claim 1, wherein in the standby mode, the column driver is further configured to disconnect the voltage divider unit from the supply voltage lines.

3. An arrangement as claimed in claim 1, wherein every column of the display device is assigned a column output circuit of the column driver.

4. An arrangement as claimed in claim 1, further including a switching unit that is configured to decouple the voltage divider unit from the supply voltage lines.

5. An arrangement as claimed in claim 1, wherein the voltage divider unit comprises a plurality of resistance elements connected in series between the two supply voltage lines, which resistance elements are coupled to the at least one switching matrix.

6. An arrangement as claimed in claim 1, including an amplifier unit that is coupled to an analog voltage value from an output of the at least one switching matrix for amplification, and the amplifier unit is connected to the supply voltage lines.

7. An arrangement as claimed in claim 6, wherein the amplifier unit is configured to be disconnected in the standby mode, and the supply voltage lines are configured to be connected to the columns by means of switches within the amplifier unit.

8. A display device with an arrangement as claimed in claim 1.

9. An arrangement comprising:

a display device with columns and rows, a column driver that is configured to provide voltages to the columns of the display device in dependence upon the data to be displayed, two supply voltage lines carrying a maximum and a minimum column voltage, and a processor that is configured to control the column driver, wherein the column driver includes:

at least one voltage divider unit that is arranged between the supply voltage lines for the generation of divided voltage values, and at least one amplifier unit that is configured to couple the divided voltage values to the columns, the processor is configured to control the column driver in a select one of two modes, such that, in a first operational mode, the column driver selectively couples the divided voltage values to the columns via the at least one amplifier unit, and in a second standby mode, the column driver is configured to:

disconnect the at least one amplifier unit from the supply voltage lines, and selectively connect one of the supply voltages to each of the columns.

10. An arrangement as claimed in claim 9, wherein in the standby mode, the column driver is further configured to disconnect the voltage divider unit from the supply voltage lines.

11. An arrangement as claimed in claim 9, wherein every column of the display device is assigned a column output circuit of the column driver.

12. An arrangement as claimed in claim 9, further including a switching unit that is configured to decouple the voltage divider unit from the supply voltage lines.

13. An arrangement as claimed in claim 9, wherein the voltage divider unit comprises a plurality of resistance elements connected in series between the two supply voltage lines, which elements are coupled to the at least one amplifier unit.

14. An arrangement as claimed in claim 9, wherein the at least one amplifier unit is coupled to an analog voltage value for amplification, and is connected to both supply voltage lines.

15. An arrangement as claimed in claim 9, wherein the at least one amplifier unit is configured to be disconnected in the standby mode, and the supply voltage lines are configured to be connected to the columns by means of switches within the amplifier unit.

16. An arrangement as claimed in claim 15, including at least one switching matrix that is coupled between the voltage divider unit and the at least one amplifier unit.

17. A display device with an arrangement as claimed in claim 9.

18. An arrangement comprising:

a display device with columns and rows, a column driver that is configured to provide voltages to the columns of the display device in dependence upon the data to be displayed, two supply voltage lines carrying a maximum and a minimum column voltage, and wherein the column driver includes a digital to analog converter that is arranged between the supply voltage lines and configured to provide analog voltage values to the columns, the processor is configured to control the column driver in a select one of two modes, such that, in an operational mode, the column driver selectively couples the analog voltage values to the columns, and in a standby mode, the column driver is configured to:

disconnect the digital to analog converter from the supply voltage lines, and selectively connect one of the supply voltages to each of the columns.

19. An arrangement as claimed in claim 18, wherein the digital to analog converter includes:

a voltage divider unit, and a switching matrix.

20. An arrangement as claimed in claim 19, wherein the digital to analog converter includes an amplifier unit.

* * * * *